United States Patent [19]

Greendale

[11] 4,056,852

[45] Nov. 8, 1977

[54] ADJUSTABLE HELMET SUSPENSION SYSTEM

[75] Inventor: John H. Greendale, Holliston, Mass.

[73] Assignee: The United States of America as represented by the Secretary of the Army, Washington, D.C.

[21] Appl. No.: 678,334

[22] Filed: Apr. 19, 1976

[51] Int. Cl.[2] ..... A42B 3/00

[52] U.S. Cl. ..... 2/417

[58] Field of Search ..... 2/417, 419, 416, 418, 2/420, DIG. 6; 24/204, 73 A; 128/DIG. 15

[56] References Cited

U.S. PATENT DOCUMENTS

| | | | |
|---|---|---|---|
| 2,136,678 | 11/1938 | Dym | 2/418 |
| 3,110,900 | 11/1963 | Crowdes, Jr. | 2/419 |
| 3,640,273 | 2/1972 | Ray | 24/204 X |
| 3,714,668 | 2/1973 | Mirabella | 2/419 |

FOREIGN PATENT DOCUMENTS

| | | | |
|---|---|---|---|
| 350,142 | 6/1931 | United Kingdom | 2/420 |

*Primary Examiner*—Werner H. Schroeder
*Assistant Examiner*—Peter Nerbun
*Attorney, Agent, or Firm*—Nathan Edelberg; Robert P. Gibson; Charles C. Rainey

[57] ABSTRACT

An adjustable helmet suspension system for varying the height at which a helmet is worn on the head. A doubled strand of braid, or other type of cord, supports the suspension straps of the helmet suspension system. The doubled strand of braid is made adjustable in circumference, thereby controlling the degree to which the helmet suspension straps are drawn in over the head of the wearer. Adjustment of the circumference of the doubled strand of braid is accomplished rapidly by means of a hook and pile type fastener, the hook portion of which is attached to the ends of the doubled strand of braid while the pile portion is attached to the upper surface of one of the straps of the helmet suspension system.

10 Claims, 5 Drawing Figures

ADJUSTABLE HELMET SUSPENSION SYSTEM

The invention described herein may be manufactured, used, and licensed by or for the Government for governmental purposes without the payment to me of any royalty thereon.

BACKGROUND OF THE INVENTION

This invention relates to an adjustable helmet suspension system for easily varying the height at which a helmet is suspended on the head and maintaining each adjustment with great certainty until a new adjustment is purposely made.

Various means have been employed for effecting adjustments in the height at which helmets are suspended on the heads of wearers of such helmets. Most of these are slow and cumbersome to manipulate and some of them are not very secured so that a given adjustment may slip and cause the helmet to drop and possibly result in impairment of vision in a critical combat situation.

It is an object of the present invention to provide means for adjusting the effective lengths of the suspension straps in a helmet so that the height at which the helmet is worn on the head is easily and quickly, yet surely, adjustable to permit the helmet to be worn at any selected height within certain established practical limits.

Other objects and advantages will become apparent from the following description of the invention.

SUMMARY OF THE INVENTION

An adjustable helmet suspension system for varying the height at which a helmet is worn on the head. A hook and pile type fastener is associated with one of the suspension straps of the helmet suspension system and with the ends of a doubled strand of braid, or other type of cord, which supports the helmet suspension straps and controls the degree to which the helmet suspension straps are drawn in over the head of the wearer, thus providing adjustability to the circumference of the doubled strand of braid. Adjustment of the doubled strand of braid and, thereby, of the separation of the upper ends of the suspension straps is accomplished rapidily and maintenance of the adjustment is made sure by the nature of the fastener.

DESCRIPTION OF THE PREFERRED EMBODIMENT

A feature of my invention is the provision of a relatively simple and easily manipulated means for adjusting the separation of the upper ends of the suspension straps in a helmet which ride on the upper surface of the head of the wearer of the helmet and thus support the helmet on the head at heights varying with the separation of the upper ends of the suspension straps. This feature is made possible by a combination of a doubled strand of braid, or other type of cord, formed from a single length of braid used to support the suspension straps, as will be illustrated and described hereinafter, the two ends of the length of braid being attached to one of the elements of a hook and pile type fastener so that adjustment of the circumference of the doubled strand of braid is accomplished by moving the hook element of the fastener along the pile element (or by moving the pile element along the hook element, if desired) and uniting the hook and pile elements of the fastener at relative positions which will result in the desired separation of the upper ends of the suspension straps. Thus the doubled strand portion of the braid is provided with a greater or smaller circumference, thereby allowing the upper ends of the suspension straps to be separated farther from each other when the circumference of the doubled strand portion is greater and to be drawn more closely together when the circumference of the doubled strand portion is made smaller.

The above-mentioned and other features and advantages of the invention will become more apparent by reference to the following description of one embodiment of the invention taken in conjunction with the accompanying drawings, in which.

Figure 1:
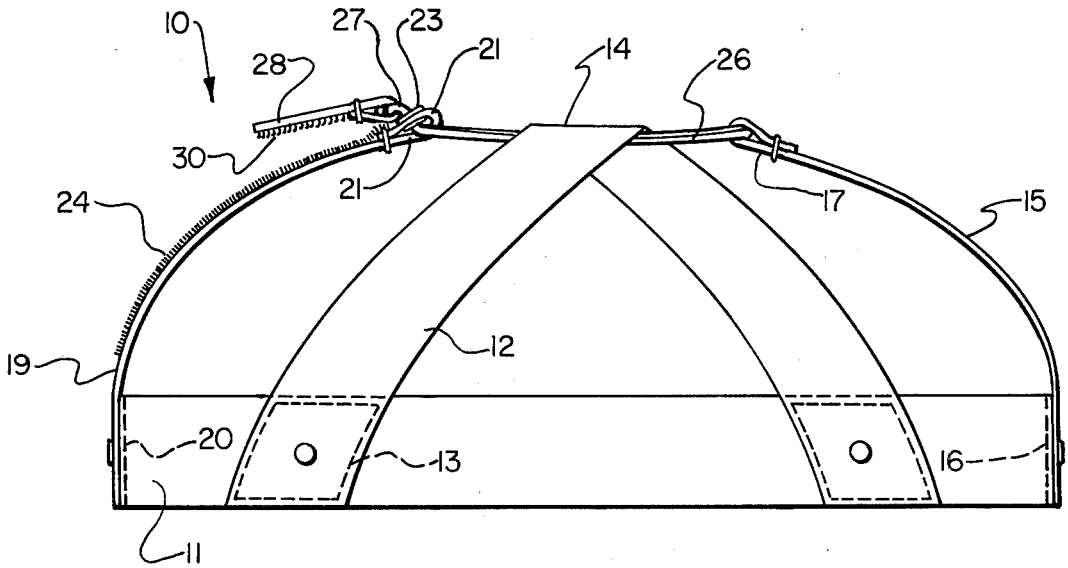
FIG. 1 is a side view in elevation of an adjustable helmet suspension system in accordance with the invention.

Referring to the drawings, the adjustable helmet suspension system is generally represented by reference numeral 10 and comprises an outer headband 11 which is made of a size to fit snugly within the inner periphery of a helmet (not shown) with which the helmet suspension system is intended to be closely associated in use being normally attached to the inner surface of the helmet at a plurality of points, normally six, spaced about the inner peripheral surface of the helmet and serving with other elements of a helmet suspension system to support the helmet on the head of the wearer. An inner headband (not shown) is normally attached to the outer headband at a plurality of points and held in close association with the outer headband by means of headband clips or otherwise. The inner headband is usually adjustable to fit snugly about the periphery of the head of the wearer of the helmet containing the helmet suspension system at a level suitable for maintaining the helmet in a relatively stable attitude on the head of the wearer. Attached to each side of headband 11 at spaced apart points is a side suspension strap 12, shown in FIG. 3 in a plan view prior to attachment thereof to the headband, and in FIGS. 1 and 2 in operating position after attachment to the headband. The attachment of the side suspension straps to the headband may be by means of stitches 13 or other suitable means for attaching pieces of fabric together. The side suspension straps are sufficiently long so that even though the two ends thereof are spaced apart a considerable distance along a side of the headband, each side suspension strap forms a loop 14, the purpose of which will be described below. It will be apparent that in order to form the loop 14 as shown in FIG. 1, the side suspension strap 12 will be attached to the headband so that one face of the fabric of the side suspension strap at one end is in direct contact with the headband while the opposite face thereof at the other end is in direct contact with the headband.

The helmet suspension system also comprises a front suspension strap 15 which is attached at one end thereof to the headband 11 at approximately the midpoint of the front of the headband by stitches 16 or other suitable means for attaching pieces of fabric together. The free end of the front suspension strap 15 has a loop 17 formed therein by folding it over and applying stitches 18 across the double thickness of fabric at a spaced interval from the bight. The purpose of this loop will also be described below.

The helmet suspension system also comprises a rear suspension strap 19 which is attached at one end thereof to the headband 11 at approximately the midpoint of the rear of the headband by stitches 20 or other suitable means for attaching pieces of fabric together. The free end of the rear suspension strap 19 has a loop 21 formed therein by folding it over and applying stitches 22 across the double thickness of fabric at a spaced interval from the bight after first installing two metallic or other types of eyes 23 in the folded over portion of loop 21, spaced from the bight of the loop and also spaced from stitches 22, the centers of the two eyes lying in a line which is substantially perpendicular to the side edges of the rear suspension strap 19. The rear suspension strap also has a strip of pile element 24 of a hook and pile fastener attached by stitches 25 to its upper surface and extending from about the edge of the eyes 23 to about the upper edge of the headband. This provides a span of pile element 24 of about 3 to 4 inches in most helmet suspension systems.

Figure 2:
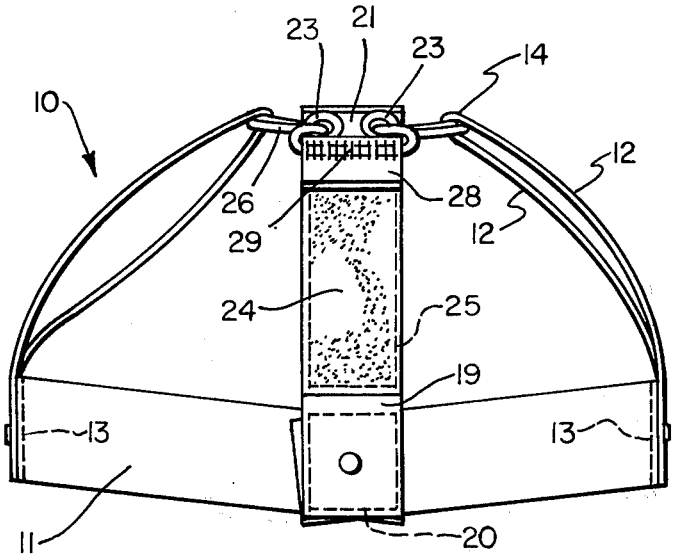
FIG. 2 is a rear view in elevation of the adjustable helmet suspension system shown in FIG. 1.
Figure 3:
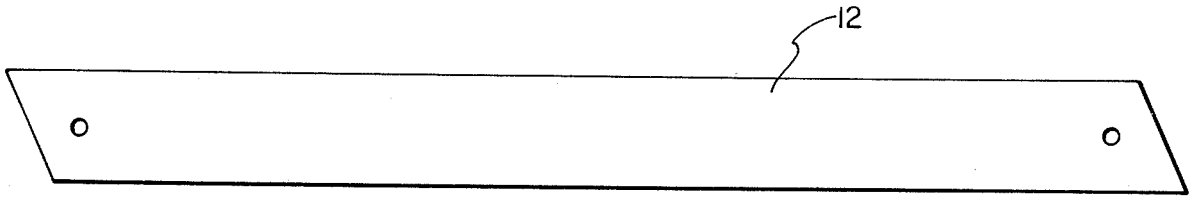
FIG. 3 is a plan view of one of the side suspension straps prior to incorporation thereof into the helmet suspension system as shown in FIGS. 1 and 2.
Figure 5:
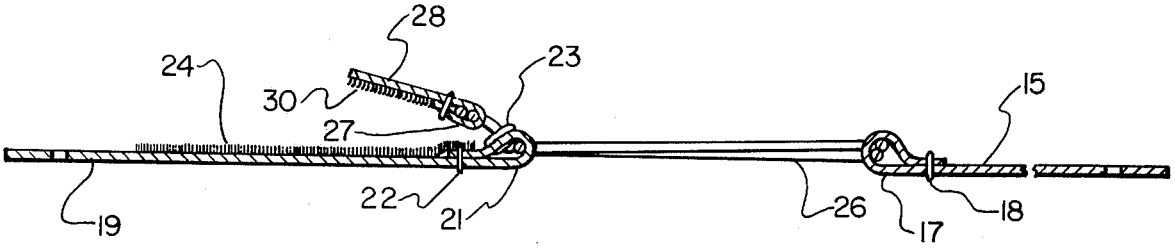
FIG. 5 is a vertical sectional view of the rear and front suspension straps including the hook and pile fastener elements, as shown in FIG. 4, taken through the plane represented by 5—5 in FIG. 4.
Figure 4:
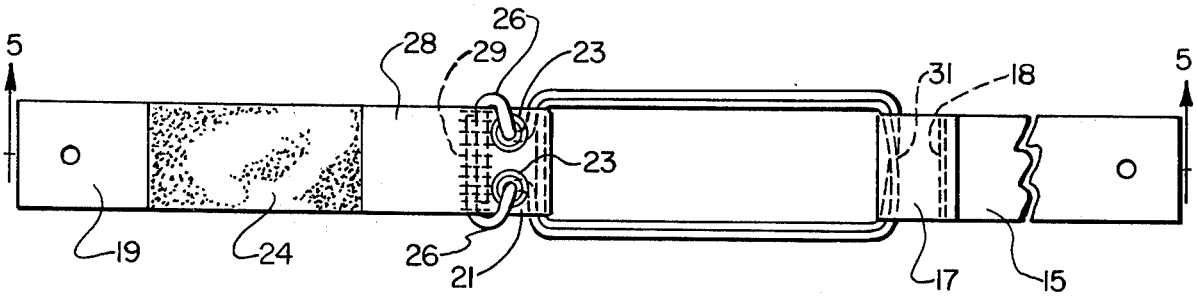
FIG. 4 is a plan view of the rear and front suspension straps supported by the doubled strand of braid, including the hook and pile fastener elements which provide ease of adjustment of the diameter of the doubled strand of braid supporting the suspension straps.

A strand of braid 26 of suitable diameter and length for threading through the eyes 23 and the loops 14 of the side suspension straps and loop 17 of the front suspension strap so as to form a doubled strand capable of being readily adjusted with respect to circumference is installed, as shown in FIGS. 1 and 2, and the ends of the stand of braid are threaded through eyes 23 and passed side-by-side through a loop 27 formed in a tab 28 and anchored therein by stitches 29. Tab 28 comprises the hook element of a hook and pile fastener having the nylon or other hook members 30 on the bottom face of the tab so that they will make contact with the pile element 24 at various positions along rear suspension strap 19, thereby providing adjustability in length to the braid 26 supporting the suspension straps. When the tab is attached to the rear suspension strap adjacent to the upper end thereof, as shown in FIG. 4, the circumference of the doubled strand of braid is at its greatest and the helmet suspension system, and therefore the helmet, will be supported on the head of the wearer at the lowest level when using this suspension system. When it is desired to raise the suspension system, and therefore the helmet, on the head of the wearer, tab 28 is detached from the pile element 24 and then reattached thereto at a lower level, the braid being drawn through the eyes, thus reducing the circumference of the doubled strand of braid and raising the loops in the suspension straps higher on the head of the wearer, thereby raising the headband and the helmet. The crossing over 31 of the braid, as shown in FIG. 4, makes possible this decrease or increase in the circumference of the doubled strand of braid. The crossing over point may occur at any point in the circumference and, therefore, need not be exactly as shown in FIG. 4.

If desired, the tab 28 could contain the pile element and the rear suspension strap 19 could have a hook element for a hook and pile type fastener applied thereto, the essential requirement being that the elements of the fastener be easily adjusted and that, once adjusted, they retain such adjustment with great certainty until purposely readjusted.

It is to be understood that various types of cord may be employed in the adjustable helmet suspension system of the invention even though braid is preferred for the purpose of providing support for the suspension straps because of its great strength and durability compared with ordinary cord of like weight and material.

It is also to be understood that the hook and pile fastener could be incorporated in the helmet suspension system in connection with the front suspension strap instead of the rear suspension strap, if desired.

I wish it to be understood that I do not desire to be limited to the exact details described, for obvious modifications will occur to a person skilled in the art.

I claim:

1. In an adjustable helmet suspension system for adjusting the height at which a helmet is worn on the head comprising a headband sized to fit snugly within said helmet and to be attached to the inner surface of said helmet at a plurality of points, a front suspension strap attached at one end thereof to said headband at approximately the midpoint of the front of said headband and having a loop formed at the free end thereof, and a rear suspension strap attached at one end thereof to said headband at approximately the midpoint of the rear of said headband and having a loop formed at the free end thereof, the improvement which comprises, a continuous strand of cord having two ends, said continuous strand of cord being threaded through the loops of said front and rear suspension straps in such a way as to form a doubled strand of said cord to support said front and rear suspension straps in operating position resting against the head of the wearer, said doubled strand being adjustable in circumference by having each of said two ends of said continuous strand of cord forming said doubled strand attached to a tab which comprises the hook elements of a hook and pile fastener and by having the pile element of said hook and pile fastener attached to said rear suspension strap, said pile element and said hook elements cooperating for adjustably fastening said tab at various positions along said rear suspension strap and firmly holding said tab with said doubled strand of cord adjusted to greater or smaller circumferences, said suspension straps being thereby rendered adjustable so that the ends thereof through which said continuous strand is threaded are spaced farther apart or closer together on the head of the wearer by the adjustment of the circumference of said doubled strand of cord, whereby the height at which a helmet containing said adjustable helmet suspension system is supported on the head of the wearer is adjustable.

2. An adjustable helmet suspension system according to claim 1, wherein said pile element of said hook and pile fastener is attached to said front suspension strap so as to cooperate with said hook elements of said tab.

3. An adjustable helmet suspension system according to claim 1, wherein said rear suspension strap has hook elements of a hook and pile fastener attached thereto and said tab has pile elements of a hook and pile fastener attached thereto to cooperate with said hook elements of said rear suspension strap.

4. An adjustable helmet suspension system according to claim 2, wherein said front suspension strap has hook elements of a hook and pile fastener attached thereto and said tab has pile elements of a hook and pile fastener attached thereto to cooperate with said hook elements of said front suspension strap.

5. An adjustable helmet suspension system according to claim 1, wherein said helmet suspension system also comprises side suspension means supported by said doubled strand of said cord between said front and rear suspension straps along the sides of said headband when said helmet suspension system is in its operating position with said side suspension means also resting against the head of the wearer.

6. An adjustable helmet suspension system according to claim 1 wherein said helmet suspension system also comprises two side suspension straps, the two ends of each side suspension strap being attached to said headband at spaced apart points along one of the two sides of said headband, each of said side suspension straps forming a loop approximately midway between said two ends thereof, said doubled strand of said cord also being threaded through the loops of said side suspension straps, whereby said side suspension straps are also supported by said doubled strand of said cord when said helmet suspension system is in its operating position with said side suspension straps also resting against the head of the wearer.

7. An adjustable helmet suspension system according to claim 1, wherein said loop formed at the free end of said rear suspension strap has two eyes mounted in and passing through the upper arm of said loop, said eyes being spaced apart along a line passing through the centers thereof substantially perpendicular to the side edges of said rear suspension strap, each of the two ends of said strand of cord being threaded through one of said eyes and thereafter both of said ends of said strand of cord being threaded side-by-side through a loop of fabric formed in said tab, said two ends of said strand of cord being stitched to the fabric forming said loop of said tab.

8. An adjustable helmet suspension system according to claim 6, wherein said loop formed at the free end of said rear suspension strap has two eyes mounted in and passing through the upper arm of said loop, said eyes being spaced apart along a line passing through the centers thereof substantially perpendicular to the side edges of said rear suspension strap, each of the two ends of said strand of cord being threaded through one of said eyes and thereafter both of said ends of said strand of cord being threaded side-by-side through a loop of fabric formed in said tab, said two ends of said strand of cord being stitched to the fabric forming said loop of said tab.

9. An adjustable helmet suspension system according to claim 6, wherein said cord is braided.

10. An adjustable helmet suspension system according to claim 8, wherein said cord is braided.

* * * * *